United States Patent [19]

Pass

[11] Patent Number: 4,778,404

[45] Date of Patent: Oct. 18, 1988

[54] SPRING TERMINAL

[75] Inventor: Raymond V. Pass, Camp Hill, Pa.

[73] Assignee: AMP Incorporated, Harrisburg, Pa.

[21] Appl. No.: 186,762

[22] Filed: Apr. 22, 1988

Related U.S. Application Data

[63] Continuation of Ser. No. 566,011, Dec. 27, 1983, abandoned.

[51] Int. Cl.[4] ..... H01R 4/24

[52] U.S. Cl. ..... 439/387

[58] Field of Search ..... 439/387, 816, 877

[56] References Cited

U.S. PATENT DOCUMENTS

| | | | |
|---|---|---|---|
| 2,644,145 | 6/1953 | Adams . | |
| 3,305,216 | 4/1974 | Gaspar et al. . | |
| 3,380,012 | 4/1968 | Moulin | 339/95 R |
| 3,963,302 | 6/1976 | Tourley | 339/276 T |

FOREIGN PATENT DOCUMENTS

| | | | |
|---|---|---|---|
| 777988 | 7/1957 | United Kingdom | 339/276 T |

*Primary Examiner*—Joseph H. McGlynn

*Attorney, Agent, or Firm*—Katherine A. Nelson

[57] ABSTRACT

A longitudinally resilient electrical terminal is stamped and formed from a unitary piece of metal stock and has a front contacting body, an intermediate spring body and a rear body including conductor terminating means. The intermediate spring portion is formed by a number of spring sections each of which has pairs of legs angularly positioned with respect to each other and joined at their adjacent ends to form a zig-zag configuration. The terminal is formed into a generally cylindrical shape with the intermediate portion providing somewhat of a helical spring configuration and resulting action. The amount of spring force generated by the subject terminal is determined by the stock characteristics, as well as the number of spring sections, the relative angle between the legs, and the tightness of the curl in forming the cylindrical configuration. The conductor terminating means can be a crimp or other known means. The subject terminal is preferably utilized in a known connector configuration and can quite effectively be used in a sealed environment.

8 Claims, 3 Drawing Sheets

SPRING TERMINAL

This application is a continuation of application Ser. No. 566,011 filed 12/27/83, now abandoned.

The present invention relates to an electrical terminal and in particular to a one piece stamped and formed spring terminal having longitudinal spring action.

There is a line of electrical connectors which are used in difficult environmental situations, such as might be encountered by the military, in which there is the requirement for mating connector members to be fully sealed. These requirements include being sealed in both mated and an unmated conditions and yet having sufficient spring action between mating terminals to provide a good electrical contact. This has been accomplished in the past but the previous solutions have always required the use of multipiece terminals which form a spring and seal assembly. Examples of previous terminals and the type of connectors in consideration may be found in U.S. Pat. Nos. 2,644,145 and 3,805,216.

The present invention obviates the difficulties encountered in the above discussed patents by providing an integral terminal which has a contacting portion, a spring portion and a conductor gripping portion formed by a one piece stamped and formed member. The present invention is somewhat similar to the terminals described in U.S. Pat. Nos. 3,439,316; 3,553,632; 3,573,718; and 3,721,944 all of which relate to a terminal sold by the common assignee and known as a "Chevron" terminal. These terminals are one piece stamped and formed members with an intermediate portion having the shape of a military chevron and formed into a cylindrical configuration to receive a pin terminal therein. The chevron portion allows a degree of radial expansion so as to tightly grip the inserted pin terminal in constricting fashion. The prior art terminals are generally unrestricted in their peripheral dimension to allow for the radial expansion of the respective chevrons.

In contradistinction to the prior art the present invention is formed of a single piece of conductive material and is mounted in a connector so as to be somewhat restricted about its periphery with the resulting action being a relative longitudinal resilient movement of the respective body portions of the terminal.

The present invention is stamped and formed from standard conductive metal stock and includes a first body portion, an intermediate spring portion, a second body portion, and a conductor engaging portion. The first or front body portion is profiled to define a contact tip or surface. The intermediate spring portion is formed with a plurality of spring sections, each being section defined by a pair of angularly offset legs joined at their adjacent ends, the spring force developed by the terminal being determined by the number of spring sections, the angle between the respective legs of each spring section, the characteristics of the metal stock and the final exterior dimension of the formed terminal, as determined by the cross sectional curvature. The second or rear body portion is preferably formed with mounting lances and can include a rear sealing means. The conductor engaging portion can be of any of the well known configurations such as adjacent pairs of conductor and insulation gripping tines which are crimped to the respective portions of a wire.

An example of the present invention will now be described by way of example, with reference to the accompanying drawings in which.

Figures 1, 2, 3:
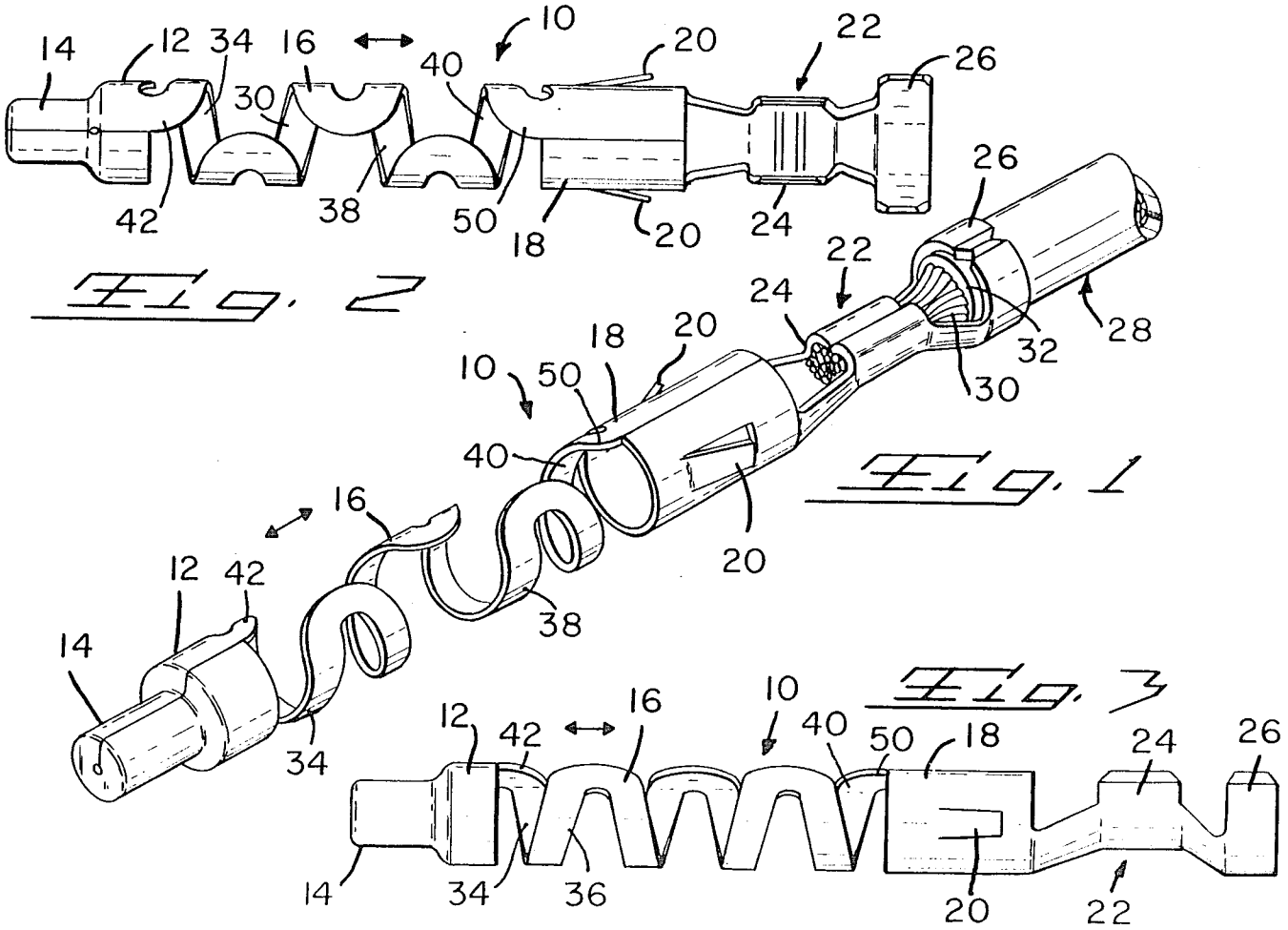
FIG. 1 is a perspective view of a terminal according to the present invention.
FIG. 2 is a top plan view of a terminal according to the present invention.
FIG. 3 is a side elevation of the terminal shown in FIG. 2.
Figure 5:
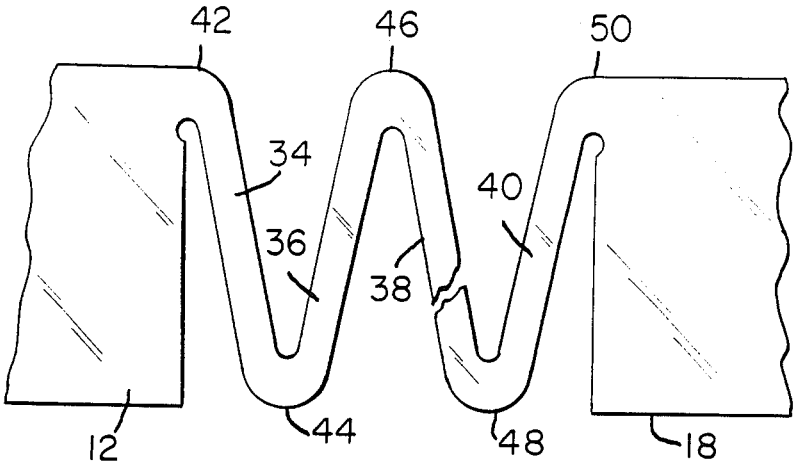
FIG. 5 is a plan view of partially stamped stock generally showing the configuration spring portion of the present invention.

Referring now to FIGS. 1 to 3, the subject terminal 10 is an integral stamped and formed member having a first body portion 12 defining a front contact area 14, a continuous, noncoiled intermediate spring portion 16, the details of which will be discussed later, a second or rear body portion 18 having mounting lances 20, and a conductor engaging portion 22. The conductor engaging portion 22 has been shown having a first pair of tines 24 and a second pair of tines 26 which are used to terminate a wire 28 by being crimped onto the conductor 30 and insulation 32, respectively. It will be appreciated from FIGS. 1 to 3, and more particularly FIG. 5, that the intermediate spring portion 16 is formed by a plurality of spring sections, Each spring section is defined by a pair of first and second adjacent angularly offset legs 34, 36, and 38, 40 respectively joined at the closely spaced ends thereof by junctions 42, 44, 46 48, 50 For purposes of illustration, the first and last spring sections are shown attached to fragmentary portions of front and rear body portions 12, 18 with spring leg 38 broken to indicate additional spring sections. First leg 34 of the first spring section is joined to front body portion 12 at junction 42 and second leg 40 of the last spring member is joined to rear body portion 18 at junction 50. The intermediate junctions 44, 46, 48 join adjacent first and second legs of respective adjacent spring sections to form a continuous series of joined spring section.

While the connector engaging portion 22 has been shown here with a well known crimp configuration, it is well within the purview of the present invention to have this portion formed with any of the well known crimp, insulation displacing, and/or solder configurations. For example, the insulation displacing configuration shown in U.S. Pat. No. 4,243,288, the disclosure of which is incorporated herein by reference, could be used.

Figure 4:
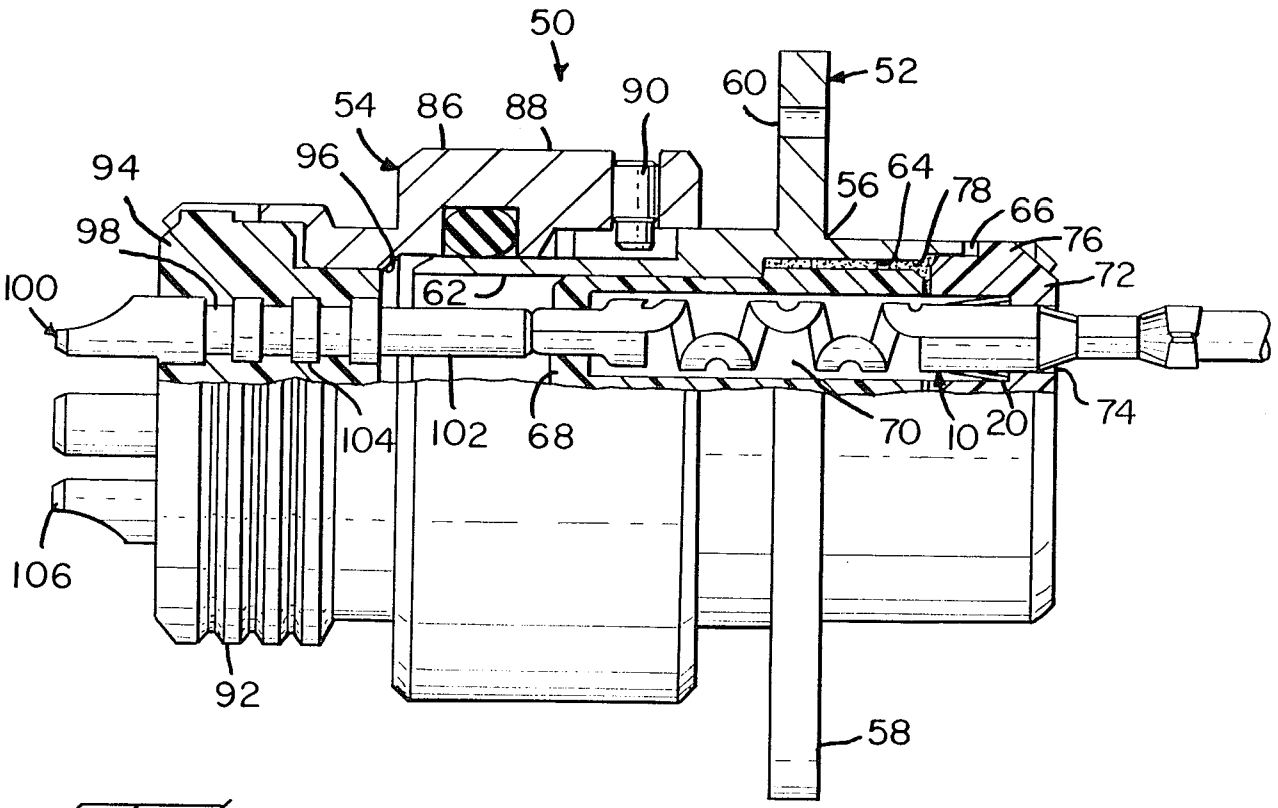
FIG. 4 is a side elevation, partially in section, showning a connector of a generally known configuration incorporating the subject terminal.
Figure 6:
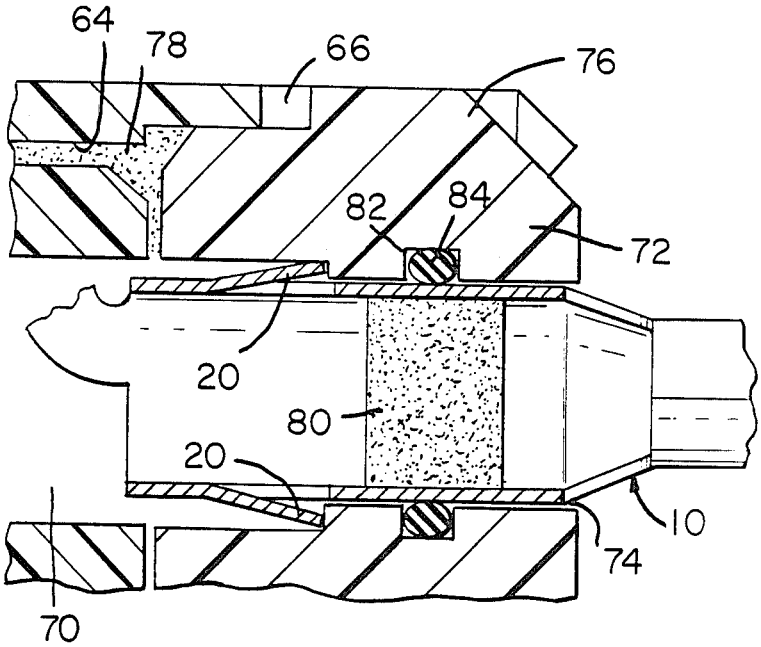
FIG. 6 is a detailed section of a connector similar to that shown in FIG. 4 having sealing means included therein.

FIGS. 4 and 6 show the subject invention as it would be used in an electrical connector 50, the connector being somewhat similar to those shown in the above-mentioned U.S. Pats. Nos. 2,644,145 and 3,805,216. The connector 50 comprises a receptacle 52 and a plug 54. In this embodiment the receptacle 52 is intended to be the fixed part of the connector and would be secured to a support (not shown) which can be the wall of a bulkhead, an equipment enclosure or the like. The plug 54 is intended to be removable from the receptacle 52 and can be provided with means (not shown) to relieve the stresses on the conductors or cables assembled therewith. The receptacle 52 has an outer metal shell 56 with a peripheral flange 58 formed with openings 60 to receive mounting means (not shown). The shell 56 defines forward annular portion 62 and rear annular portion 64. The rear portion 64 has at least one locking slot 66. A terminal carrying insert body 68, of insulative material, is profiled to be received in the bore of the forward and rear portions 62, 64. The body 68 has a plurality of profiled terminal passages 70 therein. The rear of the receptacle 52 is enclosed by a back insulator 72, which includes a plurality of terminal bores 74, each aligned with a respective passage 70, and a locking lug 76 aligned to be received in an appropriate slot 66. The receptacle 52 can be provided with a sealant 78, which would also serve to secure the body 68 and shell 56 together.

In the event that total environmental sealing was required, then the individual terminals could be provided with an internal seal 80, as shown in FIG. 6, which essentially would be a cylindrical slug of resilient insulative material which could be either inserted into the terminal of the time of forming, subsequent to forming or could be injected into the terminal after formation. In this case the back insulator 72 has annular grooves 82 formed in each bore 74 with an O-ring 84 inserted therein.

The plug 54 is shown with an annular metal shell 86 which has an inwardly profiled forward end 68 for mating engagement with the receptacle 52, the mating means are schematically shown by the inwardly directed pin 90. The shell 86 also has an outwardly directed cable engaging/strain relief engaging profile 92. An insert body 94 of insulative material is profiled to be received in the bore 96 of the shell 86. The body 44 has a plurality of bores 98, each of which receives a terminal 100 aligned to engage a respective terminal 10 in a fully mated condition of the connector 50. In this instance the terminal 100 is shown with a pin shaped forward end 102, a profiled intermediate section 104 and a solder cup rear section 102.

Assembly of an electrical connector 50 embodying the present invention will be readily apparent to those skilled in the art and need not be described with any detail. No special assembly equipment or techniques are necessary. In operation it will be noted that the subject terminal 10 will provide the necessary spring force to resiliently engage the pins 102 of the plug 54. As shown, the plug 54 would be positioned against the receptacle 52 and rotated into the fully mated position. This rotational force would cause a wiping action between the pin portion 102 of the terminals 100 and the contact areas 14 of the respective terminals 10. This wiping action would not be enough to misalign the terminals 10 but would, in fact, to a certain extent to clean the surfaces for improved electrical contact.

A further alternative to the present invention would be to replace the conductor engaging portion 22 with a second contact portion. This embodiment could be used to interconnect parallel spaced members, such as circuit boards.

It should be noted that there is no restriction on the shape of the contact portion 14. This could have any male or female configuration.

I claim:

1. A stamped and formed electrical terminal comprising:

a contact portion, a continuous noncoiled intermediate spring portion and a conductor-terminating portion;

said intermediate spring portion having first and second ends, said first end being joined to said contact portion and said second end being joined to said conductor-terminating portion, said intermediate spring portion being formed into a continuous series of spring sections having first and second legs, the first leg of the first spring section being the first end of said intermediate spring portion and the second leg of said first spring section being joined to the first leg of an adjacent spring section, the first and second legs of each succeeding spring sections being joined to respective second and first legs of adjacent spring sections and the second leg of the last spring section being the second end of said intermediate spring portion, said spring portions being formed in a noncoiled generally cylindrical configuration, whereby said intermediate spring portion provides axial spring forces to resiliently engage said terminal with a mating terminal.

2. The electrical terminal according to claim 1 wherein said contact portion is profiled to define a contact area.

3. An electrical connector having at least one of the electrical terminals according to claim 1 disposed therein.

4. The electrical terminal according to claim 1 wherein said conductor-terminating portion is profiled to define a conductor engaging means.

5. The electrical terminal according to claim 4 wherein said conductor engaging means comprises at least a pair of conductor engaging crimp tines.

6. The electrical terminal according to claim 4 wherein said conductor-terminating portion further defines mounting lances.

7. The electrical terminal according to claim 1 further comprising sealing means received within said conductor terminating portion.

8. An electrical connector having at least one of the electrical terminals according to claim 7 disposed therein.

* * * * *